US005842729A

United States Patent [19]

Bunn

[11] Patent Number: 5,842,729

[45] Date of Patent: Dec. 1, 1998

[54] LIFTING TONGS DEVICE

[76] Inventor: Stephen R. Bunn, 11128 Sunfield Dr., Midlothian, Va. 23112

[21] Appl. No.: 883,562

[22] Filed: Jun. 26, 1997

[51] Int. Cl.[6] ..... B66C 1/62

[52] U.S. Cl. ..... 294/118; 294/112

[58] Field of Search ..... 294/11, 16, 28, 294/106, 110.1, 112, 118, 119, 902

[56] References Cited

U.S. PATENT DOCUMENTS

| | | | |
|---|---|---|---|
| 393,680 | 11/1888 | Wiley | 294/112 |
| 666,474 | 1/1901 | De Wolfe | 294/16 |
| 1,128,277 | 2/1915 | Adler | 294/118 |
| 1,825,179 | 9/1931 | Collman et al. | 294/118 |
| 1,966,240 | 7/1934 | Erdahl | 294/118 |
| 2,833,433 | 5/1958 | Paananen | 294/106 X |

FOREIGN PATENT DOCUMENTS

| | | | |
|---|---|---|---|
| 1185260 | 7/1895 | France | 294/118 |
| 2237002 | 4/1991 | United Kingdom | 294/118 |

*Primary Examiner*—Johnny D. Cherry

[57] ABSTRACT

A new lifting tongs device for lifting heavy sections of cylindrical pipe. The inventive device includes a first arm member pivotally coupled to a second arm member. A first gripping member having an arcuate pipe gripping surface is coupled to the lower end portion of the first arm member. Similarly, a second gripping member having an arcuate pipe gripping surface facing the arcuate pipe gripping surface of the first gripping member is coupled to the lower end portion of the second arm member. A first flexible member is attached to the upper end portions of the arm members to force the first gripping member arcuate pipe gripping surface towards the second gripping member arcuate pipe gripping surface to grip a cylindrical object disposed between them.

11 Claims, 2 Drawing Sheets

LIFTING TONGS DEVICE

BACKGROUND OF THE INVENTION

1. Field of the Invention

The present invention relates to lifting and gripping devices and more particularly pertains to a new lifting tongs device for lifting heavy sections of cylindrical pipe.

2. Description of the Prior Art

The use of lifting and gripping devices is known in the prior art. More specifically, lifting and gripping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art lifting and gripping devices include U.S. Pat. No. 4,743,056; U.S. Pat. No. 5,409,280; U.S. Pat. No. 5,120,100; U.S. Pat. No. 4,023,848; U.S. Pat. No. 3,945,676; and U.S. Pat. No. 5,024,476.

While these devices fulfill their respective, particular objectives and requirements, the aforementioned patents do not disclose a new lifting tongs device. The inventive device includes a first arm member pivotally coupled to a second arm member. A first gripping member having an arcuate pipe gripping surface is coupled to the lower end portion of the first arm member. Similarly, a second gripping member having an arcuate pipe gripping surface facing the arcuate pipe gripping surface of the first gripping member is coupled to the lower end portion of the second arm member. A first flexible member is attached to the upper end portions of the arm members to force the first gripping member arcuate pipe gripping surface towards the second gripping member arcuate pipe gripping surface to grip a cylindrical object disposed between them.

In these respects, the lifting tongs device according to the present invention substantially departs from the conventional concepts and designs of the prior art, and in so doing provides an apparatus primarily developed for the purpose of lifting heavy sections of cylindrical pipe.

SUMMARY OF THE INVENTION

In view of the foregoing disadvantages inherent in the known types of lifting and gripping devices now present in the prior art, the present invention provides a new lifting tongs device construction wherein the same can be utilized for lifting heavy sections of cylindrical pipe.

The general purpose of the present invention, which will be described subsequently in greater detail, is to provide a new lifting tongs device apparatus and method which has many of the advantages of the lifting and gripping devices mentioned heretofore and many novel features that result in a new lifting tongs device which is not anticipated, rendered obvious, suggested, or even implied by any of the prior art lifting and gripping devices, either alone or in any combination thereof.

To attain this, the present invention generally comprises a first arm member pivotally coupled to a second arm member. A first gripping member having an arcuate pipe gripping surface is coupled to the lower end portion of the first arm member. Similarly, a second gripping member having an arcuate pipe gripping surface facing the arcuate pipe gripping surface of the first gripping member is coupled to the lower end portion of the second arm member. A first flexible member is attached to the upper end portions of the arm members to force the first gripping member arcuate pipe gripping surface towards the second gripping member arcuate pipe gripping surface to grip a cylindrical object disposed between them.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lifting tongs device apparatus and method which has many of the advantages of the lifting and gripping devices mentioned heretofore and many novel features that result in a new lifting tongs device which is not anticipated, rendered obvious, suggested, or even implied by any of the prior art lifting and gripping devices, either alone or in any combination thereof.

It is another object of the present invention to provide a new lifting tongs device which may be easily and efficiently manufactured and marketed.

It is a further object of the present invention to provide a new lifting tongs device which is of a durable and reliable construction.

An even further object of the present invention is to provide a new lifting tongs device which is susceptible of a low cost of manufacture with regard to both materials and labor, and which accordingly is then susceptible of low prices of sale to the consuming public, thereby making such lifting tongs device economically available to the buying public.

Still yet another object of the present invention is to provide a new lifting tongs device which provides in the apparatuses and methods of the prior art some of the advantages thereof, while simultaneously overcoming some of the disadvantages normally associated therewith.

Still another object of the present invention is to provide a new lifting tongs device for lifting heavy sections of cylindrical pipe.

Yet another object of the present invention is to provide a new lifting tongs device which includes a first arm member pivotally coupled to a second arm member. A first gripping member having an arcuate pipe gripping surface is coupled to the lower end portion of the first arm member. Similarly, a second gripping member having an arcuate pipe gripping surface facing the arcuate pipe gripping surface of the first gripping member is coupled to the lower end portion of the second arm member. A first flexible member is attached to the upper end portions of the arm members to force the first gripping member arcuate pipe gripping surface towards the second gripping member arcuate pipe gripping surface to grip a cylindrical object disposed between them.

Still yet another object of the present invention is to provide a new lifting tongs device that overcomes the downfalls of and problems associated with the common method of drilling a hole in a pipe to lift it by means of a cable inserted through the hole and then attempting to patch the hole.

Even still another object of the present invention is to provide a new lifting tongs device that allows the safer and more efficient lifting and setting of heavy sections of pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
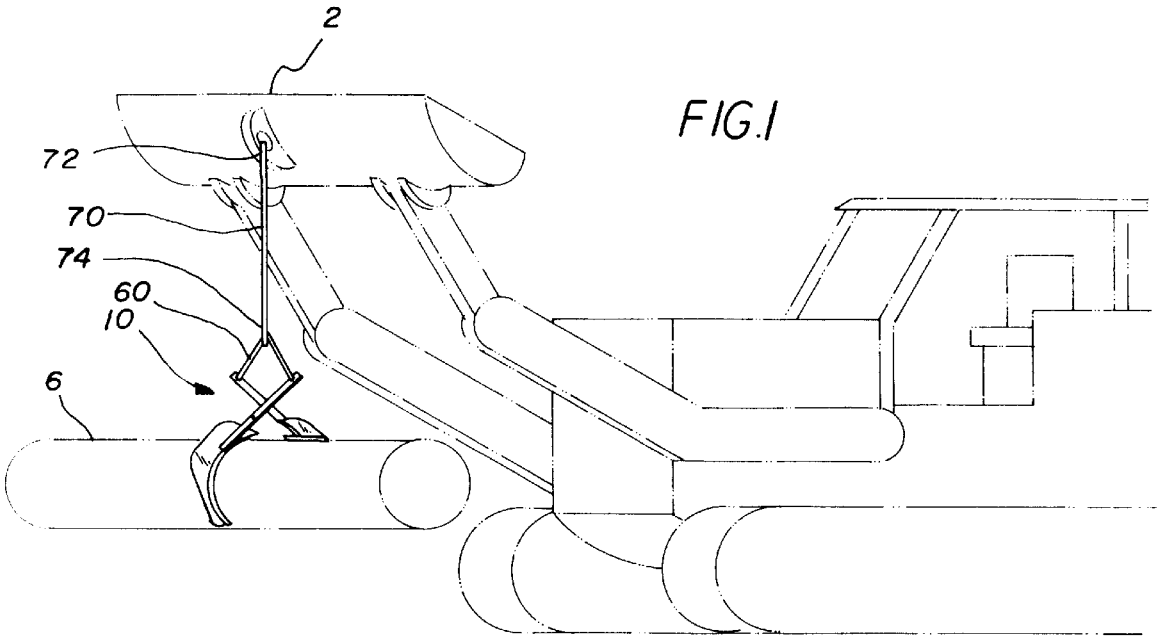
FIG. 1 is a perspective view of a new lifting tongs device in use according to the present invention.

With reference now to the drawings, and in particular to FIGS. 1 through 4 thereof, a new lifting tongs device embodying the principles and concepts of the present invention and generally designated by the reference numeral 10 will be described.

Figure 2:
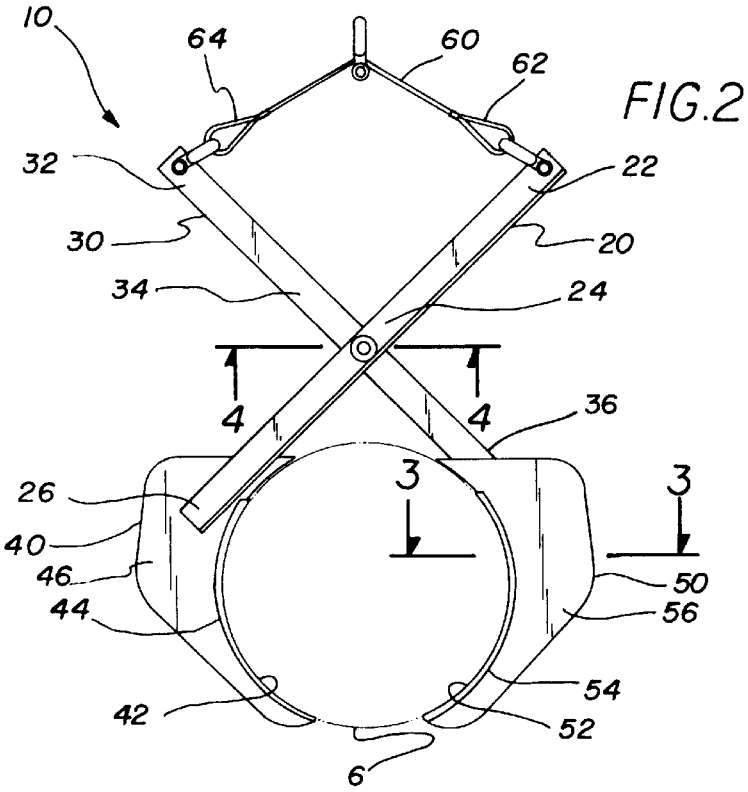
FIG. 2 is a side view of the present invention.

As best illustrated in FIGS. 1 and 2, the lifting tongs device 10 is designed to lift cylindrical objects 6 such as a concrete pipe. The lifting tongs device 10 comprises a first arm member 20 pivotally coupled to a second arm member 30. A first gripping member 40 having an arcuate pipe gripping surface 42 is coupled to the lower end portion 26 of the first arm member 20. Similarly, a second gripping member 50 having an arcuate pipe gripping surface 52 facing the arcuate pipe gripping surface 42 of the first gripping member 40 is coupled to the lower end portion 36 of the second arm member 30. A first flexible member 60 acting as a biasing means is attached to the upper end portions 22, 32 of the arm members 20, 30 to force the first gripping member arcuate pipe gripping surface 42 towards the second gripping member arcuate pipe gripping surface 52 to grip a cylindrical object 6 disposed between them.

Figure 4:
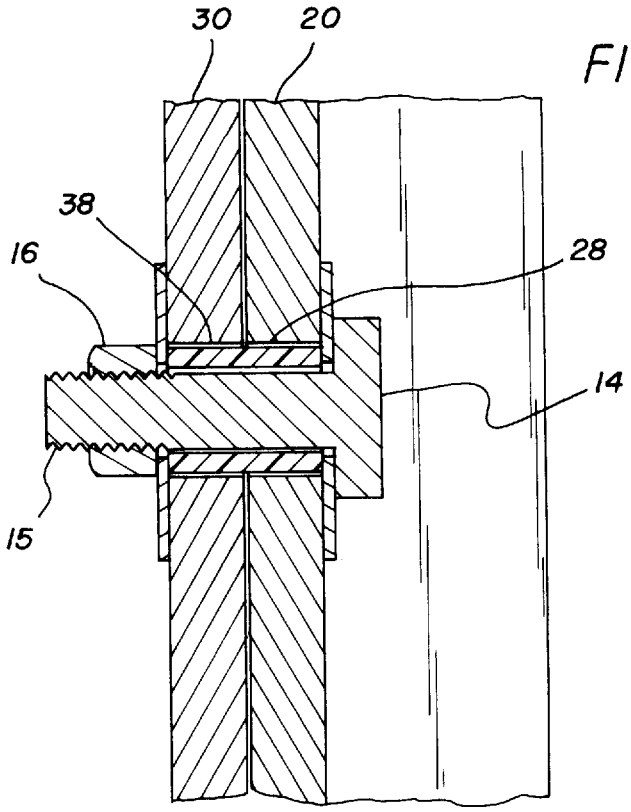
FIG. 4 is a sectional view taken from line 4—4 of FIG. 2.

As seen in FIG. 2, the first arm member 20 and the second arm member 30 each have an upper end portion 22, 32, a central portion 24, 34, and a lower end portion 26, 36. The first arm member 20 is pivotally coupled to the second arm member 30. Preferably, the second arm member 30 is pivotally coupled to the first arm member 20 at their respective central portions 24, 34. Ideally, as shown in FIG. 4, the arm members 20, 30 are coupled together by a bolt 14 with a threaded end 15 that is extended through a pivot hole 28, 38 through the central portions 24, 34 of each arm member 20, 30. The bolt 14 has a nut 16 threaded on the threaded end 15 to hold the arms together.

Figure 3:
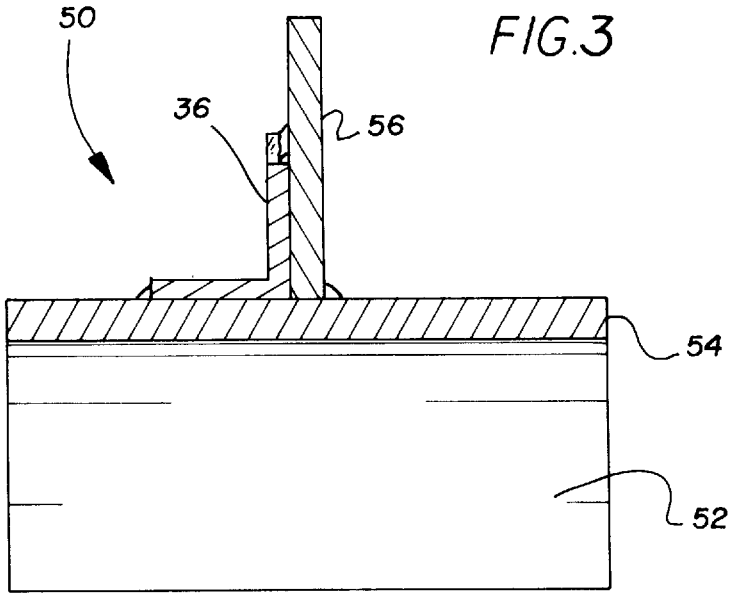
FIG. 3 is a sectional view taken from line 3—3 of FIG. 2.

With reference to FIGS. 2 and 3, the first gripping member 40 has a first gripping portion 44 and a first bracing portion 46. Preferably, the first gripping portion 44 forms an arcuate pipe gripping surface 42 of the first gripping member 40. The first bracing portion 46 is extended from the first gripping portion 44. Ideally, the first bracing portion 46 is extended perpendicularly from the first gripping portion 44.

Similarly, the second gripping member 50 has an arcuate second gripping portion 54 and a second bracing portion 56. The second gripping portion 54 forms the arcuate pipe gripping surface 52 of the second gripping member 50. The second bracing portion 56 is extended from the second gripping portion 54. Ideally, the second bracing portion 56 is extended perpendicularly from the second gripping portion 54.

Preferably, the first bracing portion 46 is attached to the lower end portion 26 of the first arm member 20. Similarly, the second bracing portion 56 is attached to the lower end portion 36 of the second arm 30. Ideally, the lower end portions 26, 36 of the arm members 20, 30 are securely connected to the bracing portions 46, 56, such as by being welded or bolted together.

The arcuate pipe gripping surface 42 of the first gripping member 40 faces the arcuate pipe gripping surface 52 of the second gripping member 50.

Preferably, the biasing means includes an elongate first flexible member 60, such as a flexible cable, with a first end 62 and a second end 64. The first end 62 of the first flexible member 60 is coupled to the upper end portion 22 of the first arm member 20. Likewise, the second end 64 of the first flexible member 60 is coupled to the upper end portion 32 of the second arm member 30. Ideally, pushing or pulling the first flexible member 60 in any direction forces the upper end portions 22, 32 of the arm members 20, 30 together. The arm members 20, 30 then force the arcuate pipe gripping surfaces 42, 52 together to grip an object 6 disposed between the arcuate pipe gripping surfaces 42, 52.

Also preferably, a second flexible member 70 has an upper end 72 and a lower end 74. The second flexible member 70 is coupled at its lower end 74 to the first flexible member 60 at a point between the first end 62 and the second end 64 of the first flexible member 60. When the second flexible member 70 is pulled by its upper end 72 in a direction away from the lifting tongs device 10, the first flexible member 60 is pulled at a point between its first end 62 and its second end 64 in a direction away from the cylindrical object 6. The first flexible member 60 forces the upper end portions 22, 32 of the arm members 20, 30 together. The arm members 20, 30 then force the arcuate pipe gripping surfaces 42, 52 together to grip an object 6 disposed between the arcuate pipe gripping surfaces 42, 52.

In use, as seen in FIG. 1, the upper end 72 of the second flexible member 70 is connected to a lifting device 2 such as a front-end loader or crane. The second flexible member 70 pulls on the first flexible member 60 causing it to force the two arm members 20, 30 together, which causes the arcuate pipe gripping surfaces 42, 52 to squeeze a cylindrical object 6 disposed between them.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lifting tongs device for helping lift sections of cylindrical pipe, comprising:

a first arm member having an upper end portion, a central portion, and a lower end portion;

a second arm member having an upper end portion, a central portion, and a lower end portion, said second arm member central portion being pivotally coupled to said first arm member central portion;

a first gripping member having an arcuate pipe gripping surface, said first gripping member being coupled to said first arm member lower end portion;

a second gripping member having an arcuate pipe gripping surface, said second gripping member being coupled to said second arm lower end portion, said first gripping member arcuate pipe gripping surface facing said second gripping member arcuate pipe gripping surface;

biasing means for forcing said first gripping member arcuate pipe gripping surface towards said second gripping member arcuate pipe gripping surface to grip an object disposed therebetween;

wherein said biasing means includes an elongate first flexible member having a first end and a second end, said first flexible member first end being coupled to said first arm member upper end portion, said first flexible member second end being coupled to said second arm member upper end portion, wherein said first gripping member arcuate pipe gripping surface is forced towards said second gripping member arcuate pipe gripping surface when said first flexible member is pulled at a point between said first flexible member first end and said first flexible member second end;

a second flexible member having an upper end and a lower end, said second flexible member lower end being slidably coupled to said first flexible member at a point between said first flexible member first end and said first flexible member second end such that said first gripping member arcuate pipe gripping surface is forced towards said second gripping member arcuate pipe gripping surface when said second flexible member is pulled, said second flexible member lower end being slidable between said first and second ends of said first flexible member; and wherein said arcuate pipe gripping surfaces of said first and second gripping members are positionable in a first position such that said pipe gripping surfaces lie on the circumference of an imaginary circle when said first and second arm members are in a first position and wherein in said first position the arcuate pipe gripping surfaces have upper portions that extend toward each other along the circumference of said imaginary circle for resisting a pipe from slipping on said gripping surfaces and contacting the arm member during use thereof.

2. The lifting tongs device of claim 1, wherein said first gripping member includes an arcuate first gripping portion and a first bracing portion, said first gripping portion forming said first gripping member arcuate pipe gripping surface, said first bracing portion being extended from said first gripping portion, wherein said second gripping member includes an arcuate second gripping portion and a second bracing portion, said second gripping portion forming said second gripping member arcuate pipe gripping surface, said second bracing portion being extended from said second gripping portion.

3. The lifting tongs device of claim 2, wherein said first bracing portion is coupled to said first arm member lower end portion, and wherein said second bracing portion is coupled to said second arm lower end portion, said first gripping member arcuate pipe gripping surface facing said second gripping member arcuate pipe gripping surface.

4. The lifting tongs device of claim 3, wherein said first bracing portion is extended substantially perpendicular from said first gripping portion, wherein said second bracing portion is extended substantially perpendicular from said second gripping portion.

5. The lifting tongs device of claim 2, wherein said pipe gripping surface of said first gripping member has a top end and a bottom end, wherein the angle between a line from the midpoint of said imaginary circle to said top end of said arcuate pipe gripping surface of said first gripping member and a line from the midpoint of said imaginary circle to said bottom end of said arcuate pipe gripping surface of said first gripping member is between about 120° and 140°.

6. The lifting tongs device of claim 5, wherein said first gripping portion has an upper end and a lower end, wherein the angle between a line from the midpoint of said imaginary circle to said upper end of said first gripping portion and a line from the midpoint of said imaginary circle to said lower end of said first gripping portion of said first gripping member is between about 100° and 120°.

7. The lifting tongs device of claim 2, wherein said first and second bracing portions each have a top edge, a side edge, and a bottom edge, said bottom edges of said first and second bracing portions being longer than said side edges of said first and second bracing portions.

8. The lifting tongs device of claim 7, wherein said bottom edge of said first bracing portion tapers towards said first gripping portion along its length from said side edge of said first bracing portion towards said bottom end of said first gripping member arcuate pipe gripping surface, wherein said bottom edge of said second bracing portion tapers towards said second gripping portion along its length from said side edge of said second bracing portion towards said bottom end of said first gripping member arcuate pipe gripping surface.

9. The lifting tongs device of claim 1, wherein said second flexible member upper end is for attachment to a lifting device.

10. The lifting tongs device of claim 1, wherein said first arm member has an L-shaped cross section perpendicular to the longitudinal axis of said first arm member, said second arm member having an L-shaped cross section perpendicular to the longitudinal axis of said second arm member.

11. A lifting tongs device for helping lift sections of cylindrical pipe, comprising:

a first arm member having an upper end portion, a central portion, a lower end portion, and upper and lower ends;

a second arm member having an upper end portion, a central portion, a lower end portion, and upper and lower ends, said second arm member central portion being pivotally coupled to said first arm member central portion such that the distance between the pivot point and a respective upper end of said first and second arm members is substantially the same as the distance between the pivot point and the associated lower end of each of said first and second arm members;

wherein said first arm member has an L-shaped cross section perpendicular to the longitudinal axis of said first arm member, said second arm member having an L-shaped cross section perpendicular to the longitudinal axis of said second arm member;

a first gripping member having an arcuate pipe gripping surface, said first gripping member being coupled to said first arm member lower end portion;

a second gripping member having an arcuate pipe gripping surface, said second gripping member being coupled to said second arm lower end portion, said first gripping member arcuate pipe gripping surface facing said second gripping member arcuate pipe gripping surface;

wherein said first gripping member includes an arcuate first gripping portion and a first bracing portion, said first gripping portion forming a portion of said first gripping member arcuate pipe gripping surface, said first bracing portion being extended from said first gripping portion, wherein said second gripping member includes an arcuate second gripping portion and a second bracing portion, said second gripping portion forming a portion of said second gripping member arcuate pipe gripping surface, said second bracing portion being extended from said second gripping portion;

wherein said first bracing portion is coupled to said first arm member lower end portion, and wherein said second bracing portion is coupled to said second arm lower end portion, said first gripping member arcuate pipe gripping surface facing said second gripping member arcuate pipe gripping surface;

wherein said first bracing portion is extended substantially perpendicular from said first gripping portion, wherein said second bracing portion is extended substantially perpendicular from said second gripping portion;

wherein said first and second bracing portions each have a top edge, a side edge, and a bottom edge, said bottom edges of said first and second bracing portions being longer than said side edges of said first and second bracing portions;

wherein said bottom edge of said first bracing portion tapers towards said first gripping portion along its length from said side edge of said first bracing portion towards said bottom end of said first gripping member arcuate pipe gripping surface, wherein said bottom edge of said second bracing portion tapers towards said second gripping portion along its length from said side edge of said second bracing portion towards said bottom end of said first gripping member arcuate pipe gripping surface;

wherein said pipe gripping surface of said first gripping member has a top end and a bottom end, wherein the angle between a line from the midpoint of said imaginary circle to said top end of said arcuate pipe gripping surface of said first gripping member and a line from the midpoint of said imaginary circle to said bottom end of said arcuate pipe gripping surface of said first gripping member is between about 120° and 140°;

wherein said first gripping portion has an upper end and a lower end, wherein the angle between a line from the midpoint of said imaginary circle to said upper end of said first gripping portion and a line from the midpoint of said imaginary circle to said lower end of said first gripping portion of said first gripping member is between about 100° and 120°;

biasing means for forcing said first gripping member arcuate pipe gripping surface towards said second gripping member arcuate pipe gripping surface to grip an object disposed therebetween wherein said biasing means includes an elongate first flexible member having a first end and a second end, said first flexible member first end being coupled to said first arm member upper end portion, said first flexible member second end being coupled to said second arm member upper end portion, wherein said first gripping member arcuate pipe gripping surface is forced towards said second gripping member arcuate pipe gripping surface when said first flexible member is pulled at a point between said first flexible member first end and said first flexible member second end;

a second flexible member having an upper end and a lower end, said second flexible member lower end being slidably coupled to said first flexible member at a point between said first flexible member first end and said first flexible member second end such that said first gripping member arcuate pipe gripping surface is forced towards said second gripping member arcuate pipe gripping surface when said second flexible member is pulled;

said second flexible member lower end being slidable between said first and second ends of said first flexible member, said second flexible member upper end being for attachment to a lifting device; and wherein said arcuate pipe gripping surfaces of said first and second gripping members are positionable in a first position such that said pipe gripping surfaces lie on the circumference of an imaginary circle when said first and second arm members are in a first position and wherein in said first position the arcuate pipe gripping surfaces have upper portions that extend toward each other along the circumference of said imaginary circle for resisting a pipe from slipping on said gripping surfaces and contacting the arm member during use thereof.

* * * * *